US005741174A

United States Patent [19]

Kaiser, Jr. et al.

[11] Patent Number: 5,741,174

[45] Date of Patent: Apr. 21, 1998

[54] MULTIPLE GRINDING MACHINE WITH CONTOURING FEED UNITS

[75] Inventors: Russell E. Kaiser, Jr., Mercersburg; Ricky L. Mowen; Timothy W. Hykes, both of Greencastle; Dennis A. Fortney, Waynesboro; Dennis F. Rice, Chambersburg, all of Pa.

[73] Assignee: Western Atlas Inc., Waynesboro, Pa.

[21] Appl. No.: 304,233

[22] Filed: Sep. 12, 1994

Related U.S. Application Data

[62] Division of Ser. No. 953,799, Sep. 30, 1992, Pat. No. 5,371,973.

[51] Int. Cl.[6] ..... B24B 5/16; B24B 41/00

[52] U.S. Cl. ..... 451/307; 451/454

[58] Field of Search ..... 451/307, 303, 451/296, 251, 62, 454

[56] References Cited

U.S. PATENT DOCUMENTS

| | | | |
|---|---|---|---|
| 4,175,388 | 11/1979 | Bischeri | 451/307 |
| 4,945,683 | 8/1990 | Phillips | 451/307 |
| 5,210,978 | 5/1993 | Phillips | 451/303 |
| 5,251,404 | 10/1993 | Wasserbaech | 451/303 |
| 5,367,866 | 11/1994 | Phillips | 451/303 |

*Primary Examiner*—Robert A. Rose
*Attorney, Agent, or Firm*—Hoffman, Wasson & Gitler

[57] ABSTRACT

A grinding machine utilizing multiple, parallel, endless, abrasive belts for simultaneously grinding several surfaces on a workpiece, such as cam lobes on a cam shaft. The grinding machine includes a contouring head assembly comprising a plurality of contour feed units, each contour unit including a curved back-up shoe, a back-up shoe holder, an adaptor for mounting the shoe holder, and a ball-spline mechanism is secured to the adaptor for transmitting power from a drive motor to the back-up shoe to press an abrasive belt, associated with the back-up shoe against a workpiece. A locating lip is defined on each adaptor, and a reference pad is established on the contouring head assembly.

The adapters are divided into an upper and lower row, and the locating lips are formed oversized. One row of lips is ground to a desired distance from the reference pad, and the other row of lips is then ground relative to the previously ground row of locating lips. The back-up shoe holders are then secured in position upon the locating lips. The method of assembling the machine, the enclosure that encompasses the rear face of the contouring head assembly, the laterally movable support bracket for the drive drum assembly, and several other complementary features, coact to provide a grinding machine that functions efficiently while maintaining tolerances previously unobtainable with multiple belt grinding machines.

16 Claims, 14 Drawing Sheets

MULTIPLE GRINDING MACHINE WITH CONTOURING FEED UNITS

This is a divisional of application Ser. No. 07/953,799 filed on Sep. 30, 1992, now U.S. Pat. No. 5,371,973.

FIELD OF THE INVENTION

The instant invention relates generally to machines for grinding surfaces on workpieces, such as lobes, or cams, on camshafts, diameters on crankshafts, and the like. More particularly, the invention pertains to computer controlled machines employing several abrasive belts, in parallel, to simultaneously grind several surfaces on cylindrical workpieces, such as the multiple lobes on a camshaft, or the like.

BACKGROUND OF THE INVENTION

Grinding cam lobes on a cam shaft has usually been achieved by a grinding wheel, which grinds each cam in sequence. In some instances, by resort to complex mechanical machines with two grinding heads, a pair of cams may be ground concurrently.

In response to the needs of automotive manufacturers, in particular, efforts have been made to devise and develop, a reliable grinding machine that will grind, simultaneously, a number of or all of the cams, or lobes, on a camshaft. Since camshafts are a costly and complex article of manufacture, and since the costs of manufacturing same are significant, diverse approaches have been considered to move, technically, beyond the well known techniques relying upon grinding wheels.

One alternative approach has focused upon the use of abrasive grinding belts in lieu of the conventional grinding wheel. Such approach has considerable potential, for several belts may be utilized, in side-by-side relationship, to grind the several lobes on a camshaft simultaneously. Also, the belts, if mass-produced, will be much lower in cost, and can be discarded, after usage for an extended period of time.

Abrasive grinding belts may have been initially used in Italy ten or more years ago to grind camshafts as illustrated in U.S. Pat. No. 4,175,358, granted Nov. 27, 1979, to Ido Boscheri, which discloses a plunge grinding machine employing several abrasive belts to simultaneously grind all of the cams which are present on a timing shaft for an engine. Such grinding machine includes a massive baseplate (10) which carries a table (12) which can be reciprocated (by jacks 13) with respect to the baseplate, a tail stock and head stock mounted on the table and adapted to support the camshaft (19) to be ground, and a stationary crosspiece (22) carrying a plurality of machining units. Each machining unit comprises a supporting member (31), front and rear heads (32, 33), an abrasive belt (36), jack (43), etc. that are driven by a sensing roller (42) operatively associated with a pattern piece (18) from which the workpiece (cam) to be ground is copied. Separate drive motors (15, 25) are connected through appropriate gear transmissions and couplings so that the workpiece to be ground, and the pattern piece, are rotated in the proper phase relationship.

U.S. Pat. No. 4,833,834, granted May 30, 1989, to Henry B. Patterson et al, discloses several embodiments of multiple belt camshaft grinding machines. Each grinding machine has several grinding belts (28) and a drive (such as main drive pulley 30) therefor, and contouring shoes (35) and support members (pushrods 43) carried on a feed table (12) for separate control of cam contouring and grinding feed rate. The camshaft workpiece (20) is carried on a fixed axis by a table (16) providing axial motion for belt wear balancing oscillation. The grinding operations may be controlled by master cams, as in the embodiment of FIGS. 1 and 2, or may be numerically controlled, as in the embodiments of FIGS. 3 and 6–10.

U.S. Pat. No. 4,945,683, granted Aug. 7, 1990 to James D. Phillips, discloses an apparatus for grinding, to a predetermined contour, a plurality of eccentric cams (L) on a camshaft (W). The apparatus comprises several abrasive belts (58) supported adjacent the cam shaft for linear movement, such that the belts grind the peripheries of the cams (as shown in FIGS. 1 and 8). The belts are guided along a variable path, according to the cam contour desired, by shoes (72) engaging the belts at their point of contact with the cams. The shoes are mounted on actuators (76) powered by motor units (78) controlled by CNC controllers. Each belt passes through a coolant distributor (130) so that coolant saturates each belt and conditions same for better abrading action. The pressure of fluid within each distributor causes the belt to flex, and compensates for the tendency of the belt to stretch as the shoe 72 moves in and out.

U.S. Pat. No. 5,142,827, granted Sep. 1, 1992, to James D. Phillips, discloses a crank pin grinder employing multiple abrasive belts.

The latter three patents reflect the increasing interest in grinding machines employing several abrasive belts, side by side, to grind all of the surfaces, on a workpiece. The market potential available to the manufacturer of a commercially acceptable grinding machine that employs abrasive grinding belts may be significant.

While a limited number of grinding machines using abrasive belts have been manufactured, and used commercially in the past decade, the costs of designing, operating, and maintaining such multiple belt machines, have proven to be a significant economic burden. The abrasive belts have broken frequently, or have deteriorated rapidly to produce ground surfaces that fall outside acceptable tolerances.

These aforedescribed prior art grinding machines do not provide for effective disposition of the respective grinding belts to insure accurate and optimum grinding; for selective adjustability of the belt drive and effective and efficient control of belt positioning to maximize belt life and effectiveness; or for utilization of similar assemblies at multiple locations to reduce manufacturing and maintenance costs. These, and other, shortcomings of known belt grinding machines have inhibited the widespread acceptance of grinding machines employing multiple abrasive belts, to date. Problems have also been encountered in aligning the multiple belts relative to one another, in both the horizontal, and vertical, planes. Also, the debris generated by the grinding machine has attacked the drive motors, used in the component subassemblies, and has necessitated the use of costly, sealed drive motors at various locations.

SUMMARY OF THE INVENTION

Consequently, with the deficiencies of the prior art multiple belt grinding machines clearly in mind, the instant invention envisions a grinding machine, with long-lived, endless, abrasive belts that can easily be installed, and, when necessary, removed and/or replaced. This desirable objective is realized by configuring the instant grinding machine to allow ready access to the endless belts at two locations spaced along one side of the machine. At one location, a drive drum support is moved laterally, a significant distance, to expose the multiple belts. An eccentric bushing insures that the drive drum support moves smoothly with support rods in bushings without binding or seizing. At a second location, a rotary actuator, with a locking arm, is pivoted through an arc, which may be 45°, to reveal the multiple belts trained about pulleys affixed to the underside of the contouring head assembly, at the front thereof.

The instant invention contemplates a positioning slide feed, that moves longitudinally along the bed of the grinding machine, to advance the contouring head assembly, comprised of several contouring feed units, into the grind position. A back-up shoe mounted on each contouring feed unit presses firmly against the interior surface of the associated abrasive belt and forces the belt against a surface on the workpiece, usually a lobe on the camshaft, being ground. Each contouring unit feed is capable of grinding one lobe on the camshaft.

Each back-up shoe includes a curved insert, of a relatively large radius, retained in a back-up shoe holder, to produce a more accurate contour despite geometric inconsistencies. The insert is secured within a recess in the back-up shoe holder, and the surface of the insert is treated with a diamond coating to harden same. An individual brushless motor drives each contouring feed unit through a roller screw and a ball-spline mechanism for effective actuation. Several pre-loaded angular contact bearings are used to support the inner end of each contouring feed unit and impart an unusual degree of axial "stiffness" thereto.

Each back-up shoe holder is mounted on an adaptor having a locating lip. The lower row of locating lips is correlated with a pad or other reference point, on the contouring head assembly, and the upper row of locating lips is correlated with the lower row of locating lips, so that the back-up shoes are mounted parallel to one another in two horizontal planes. The locating lip on each adaptor further insures that a center line through the base circle of each cam lobe is co-linear with a center line through the back-up shoe (when retained in the back-up shoe holder) that is parallel to the axes of movement of the contouring feed units in the contouring head assembly for greater grinding accuracy.

The drive motors for all of the contouring feed units are retained within a common enclosure secured to the rear of the contouring head assembly. The enclosure prevents debris from attacking any of the drive motors, and allows relatively inexpensive brushless motors to replace conventional, expensive sealed motors, without any diminution of performance.

To overcome any tendency of the contour head assembly to sag, even a minute fraction of an inch, the inboard side of the assembly is bolted to a standard, while a hydraulically operated locking mechanism is situated at the free, or outboard, side of the assembly. The locking mechanism relies upon an arm with a conical shaped socket to pivot into engagement with a fixed ball, or similar protuberance, on the contour head assembly. A rotary actuator, that is hydraulically operated, pivots the arm containing the socket into engagement with the ball on the contour head assembly. A hydraulic cylinder then drives a tapered piston downwardly to lock the ball and socket together and maintain the contouring head assembly in fixed position.

The carriage slide assembly, which supports the workpiece, includes, inter alia, a fixed base that is bolted to the bed of the machine, a carriage that is driven relative to the bed, and a swivel table secured to the carriage and movable relative thereto. The footstock can be moved along the swivel table. A pin depends below the swivel table into a yoke defined in the carriage. Manually operable screws engage the pin and shift the swivel table a small fraction of an inch until the desired alignment of the components of the carriage slide assembly is achieved, further enhancing the accuracy of the instant grinding machine.

The instant invention further contemplates a carriage slide assembly, comprising a motor, a lead-screw mechanism, and a flexible coupling for transmitting motive power from the motor to the carriage slide assembly; the carriage slide assembly is driven laterally across the front of the machine, into aligned position with respect to the abrasive belts. The carriage traverse assembly is configured in much the same fashion as the positioning slide feed assembly, and utilizes identical parts, in many instances, thus simplifying the manufacture of component parts, and reducing inventory problems.

The headstock is operated by command from a motion controller, and the speed of the motor incorporated into the headstock provides a digital output.

The contouring head assembly is divided into an upper and a lower row of contouring feed units. As noted previously, the locating lips retain the back-up shoe holders for each contouring feed unit in a fixed position that is aligned, in the horizontal, with every other contouring feed unit. In the unique assembly process, the locating lips are correlated with reference pads on the upper and/or lower surfaces of the contouring head assembly. The method of assembly insures that the contouring head assembly is properly aligned with respect to the swivel table of the traversing carriage. Such precise, interrelated assembly technique contributes to the superior performance characteristics obtainable by the instant machine.

Each endless abrasive belt, which maybe approximately 132 inches in total length, travels over a large pulley in the drive drum assembly and two, or more, smaller pulleys spaced along the longitudinal axis of the instant machine. The large pulley for each belt is located on a drive drum shaft that extends laterally across the machine. A prime mover, such as an electric motor, is located in operative association to the drive drum assembly to rotate same through a drive belt.

In order to provide adjustment to compensate for variances in the length or circumference of an abrasive belt, a simple mechanical connection, such as a pin and slot connection, enables the motor and drive drum assembly to move in unison relative to the contouring head assembly. Another simple mechanical connection adjusts drive belt tension by permitting the prime mover to be shifted longitudinally relative to the drive drum assembly.

The instant grinding machine also provides for digital velocity control of the brushless motors that drive the contouring feed units with great precision and reliability.

Additionally, the instant grinding machine provides a lubricating system that delivers the appropriate quantity of fluid to each belt during the grinding cycle. While the majority of the lubricant is delivered through an individual nozzle associated with each belt, a small amount of fluid is delivered, via appropriate piping, to the interior surface of each abrasive belt to lubricate and cool the belt and the back-up shoe. Each drive pulley in the drive drum assembly has a crowned configuration, and a cross-hatched, traction surface, which provides cavities to receive excess coolant therein.

Lubrication is also supplied to each contouring feed unit at several locations. Of particular utility is a nozzle located above a slot in a collar encapsulating the roller screw mechanism in each contouring feed unit; the nozzle provides lubricant to the roller screw mechanism.

The "stiffness" of the entire machine is increased beyond the level of stiffness, or rigidity, obtainable with known multiple belt grinding machines. Such structural rigidity is a reflection of the overall superior design of the present machine, and contributes to the accuracy of the grinding operations performed thereby.

Numerous other advantages attributable to the instant invention will occur to the skilled artisan, when the appended drawings are construed in harmony with the ensuing specification.

DETAILED DESCRIPTION OF THE INVENTION

Figure 1:
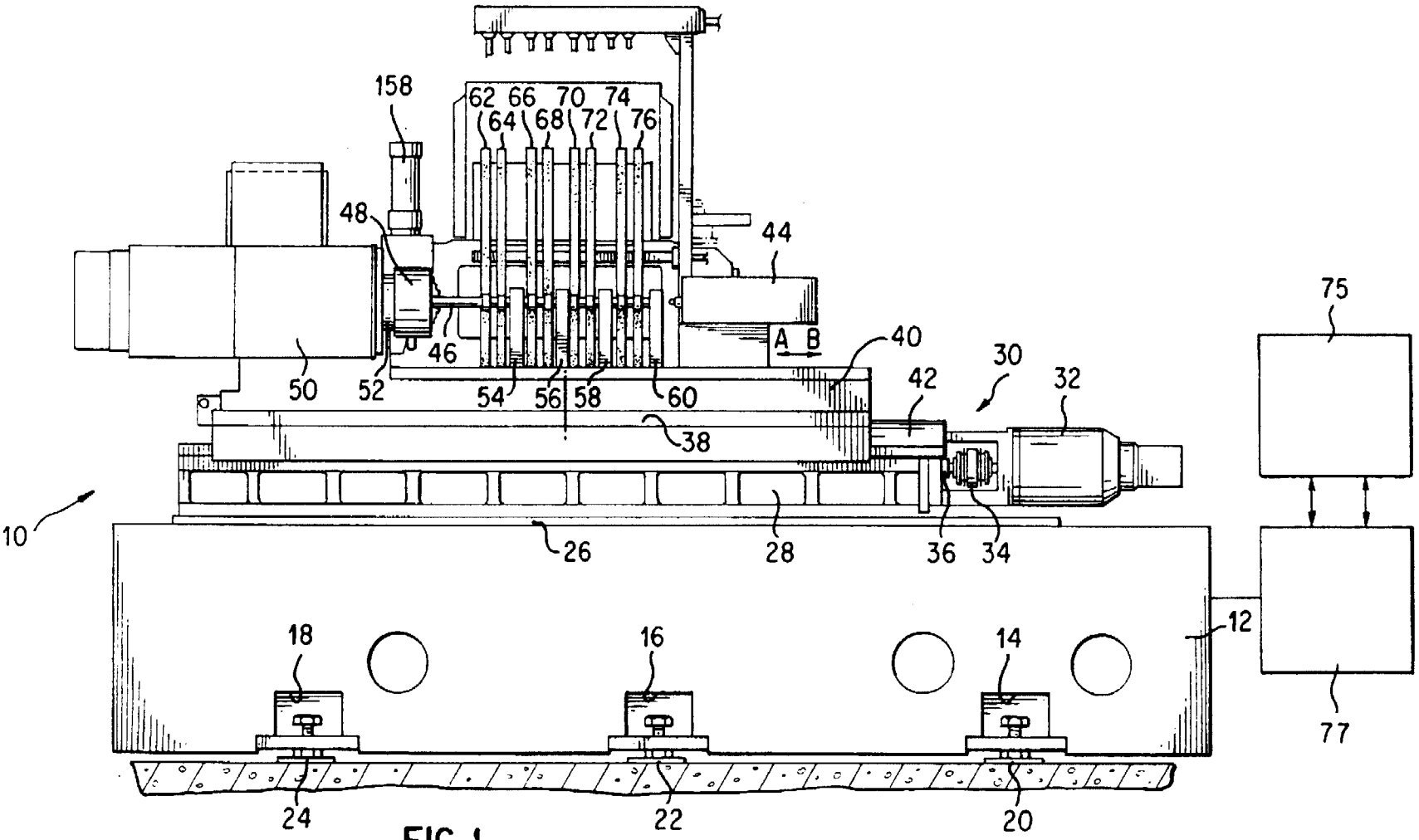
FIG. 1 is a front elevational view of a grinding machine employing several abrasive belts disposed to simultaneously grind multiple lobes on a camshaft, such machine being constructed in accordance with the principles of the instant invention.

FIG. 1 is a front elevational view of a grinding machine 10 constructed in accordance with the principles of the present invention. Machine 10 includes a massive, metal bed 12 that may be filled with concrete or similar material. Cavities 14, 16, 18 are defined in the front face of bed 12, and stabilizers 20, 22, and 24 are situated within the cavities. The stabilizers establish a level plane for the grinding machine 10, despite imperfections in the floor of the factory. Additional stabilizers are situated in additional cavities spaced about the sides, and rear face, of the bed.

Pad 26 extends transversely across machine 10, and metal base 28 is bolted to pad 26. A carriage traverse assembly, indicated generally by reference numeral 30, drives carriage 38 along base 28 to position the workpiece to be ground in alignment with the grinding belts.

Carriage traverse assembly 30 includes motor 32, coupling 34, and lead screw mechanism 36. Coupling 34 enables the motor to deliver rotational force to the lead screw mechanism 36, despite shaft misalignments, and the lead screw mechanism translates such force into linear motion which moves carriage 38 along base 28 in the direction of arrows A and B. Swivel table 40 is secured atop carriage 38, and moves in concert with the carriage. A cover 42 is secured to one side of carriage 38, and extends laterally to prevent debris from entering the narrow gap defined between carriage 38 and base 28; bearings and lubricating fluid fit within the narrow gap (not visible in FIG. 1) to insure smooth, and precise, movement of carriage 38. A second cover is secured to the opposite end of the carriage.

Tailstock 44 is secured to swivel table 40 by a dovetail connection; tailstock 44 is movable laterally along swivel table 40, as indicated by the directional arrows A and B.

Tailstock 44 is shown in FIG. 1 spaced a small distance from the right hand end of the workpiece, in this instance a camshaft 46. Alternatively, if warranted, tailstock 44 can be moved into engagement with the end of the workpiece, such as camshaft 46. The opposite end of camshaft 46 is retained within chuck 48 on headstock 50; an integral motor rotates spindle 52 and chuck 48, which supports the end of camshaft 46 during grinding operations.

Spaced work holders 54, 56, 58, and 60 grasp bearings on the camshaft. The bearings cooperate with the headstock 50 and tailstock 44 to retain the camshaft 46 in a proper position relative to grinding belts 62, 64; 66, 68; 70, 72; and 74, 76.

A programmable controller 75 (FIG. 1) of conventional construction cooperates with various electrical hydraulic mechanisms, sensing devices, and controls of machine 10 through a control unit 77 to receive signals therefrom and transmit control signals thereto to operate the motors, prime movers, hydraulic and fluid operated and other devices of machine 10.

Figure 2:
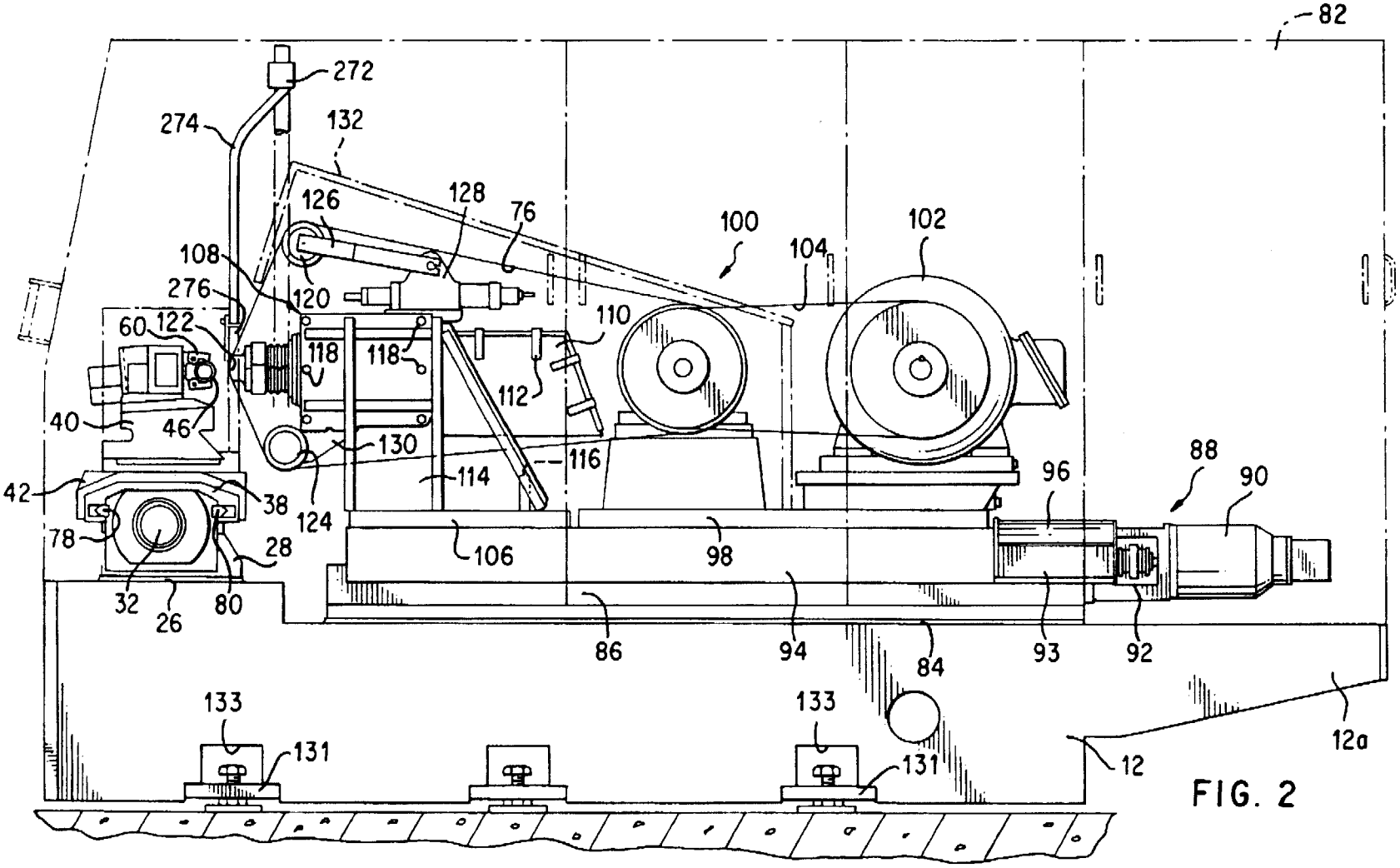
FIG. 2 is a side elevational view of the grinding machine shown in FIG. 1, such view being taken on the right side of the machine.

FIG. 2 shows additional details of carriage traverse assembly 30. For example, linear guide rails 78, 80 are situated between the inturned flanges of movable carriage 38 and base 28, and the outline of swivel table 40, is visible. Also, FIG. 2 shows that pad 26 is situated on the shoulder of bed 12, at a higher elevation than the remainder of bed 12. A cabinet 82, shown in phantom outline, surrounds the grinding machine; the lower end of the cabinet enclosure is seated in a trough (not shown) at the upper end of bed 12.

A second pad 84 extends along the longitudinal axis of machine 20, and projects above the upper edge of bed 12. A second base 86 is secured to pad 84, and extends along the longitudinal axis of the machine. A positioning slide feed assembly 88, which is configured in much the same manner as carriage traverse assembly 30, and functions in a similar manner, is indicated generally by reference numeral 88.

Positioning slide feed assembly 88 includes motor 90, flexible coupling 92, and lead screw mechanism 93. Lead screw mechanism 93 advances, or retracts, positioning slide 94 along second base 86, which extends along the longitudinal axis of machine 10. Coupling 92 transmits rotational force from motor 90 to positioning slide 94 via lead screw mechanism 93, that is shielded from view in FIG. 2 by cover 96 (but shown in FIG. 14, and discussed at a later juncture in the specification).

Positioning slide feed assembly, and carriage traverse assembly 30, are formed of identical components. Consequently, the number of spare parts needed to maintain the grinding machine in operative condition is reduced, with attendant savings in part manufacture, installation and maintenance.

Drive base 98 is situated atop positioning slide 94, and supports drive drum assembly 100 and prime mover 102. In this instance, prime mover 102 is an electric motor suitably powered and controlled, for supplying motive power, via endless drive belt 104, to drive drum assembly 100.

Support base 106 is also situated atop positioning slide 94, but is spaced a short distance away from drive base 98. Support base 106, and drive base 98, also extend transversely across positioning slide 94. While support base 106 is fixed to positioning slide 94, drive base 98, and the components resting upon the drive base, may be adjusted longitudinally, by a distance of a fraction of an inch relative to positioning slide 94. The contouring feed assembly, indicated generally by reference numeral 108, is mounted atop support base 106. A protective enclosure 110 is secured to the rear end of the contouring head assembly, and manually operable clamps 112 and screws provide access to the interior of the enclosure, when necessary.

Standard 114 extends upwardly from the right side of support base 106, and an angularly oriented brace 116 rigidifies the standard. Base 106, standard 114, and brace 116, are formed as a unitary weldment for enhanced stability and rigidity. Contouring head assembly 108 is secured to standard 114 by bolts 118.

The path of travel for abrasive belt 76 is shown in FIG. 2, and the several other abrasive belts are entrained, in parallel fashion, in a similar manner. Belt 76 passes about a drum on drive drum assembly 100, travels about pulley 120, over curved back-up shoe 122, passes over pulley 124, and returns to the drive drum assembly. Pulley 120 is secured to the free end of arm 126 that is pivotally mounted upon housing 128 that is secured to the upper surface of contouring head assembly 108. Pulley 124 is fixed by ear 130 to the front, lower corner of assembly 108.

The rear section of bed 12 situated beneath motor 90 projects upwardly and outwardly from the generally rectangular base, and forms an overhang 12*a*. Stabilizers 131 are located in cavities 133 formed in the side walls of the bed.

Figure 3:
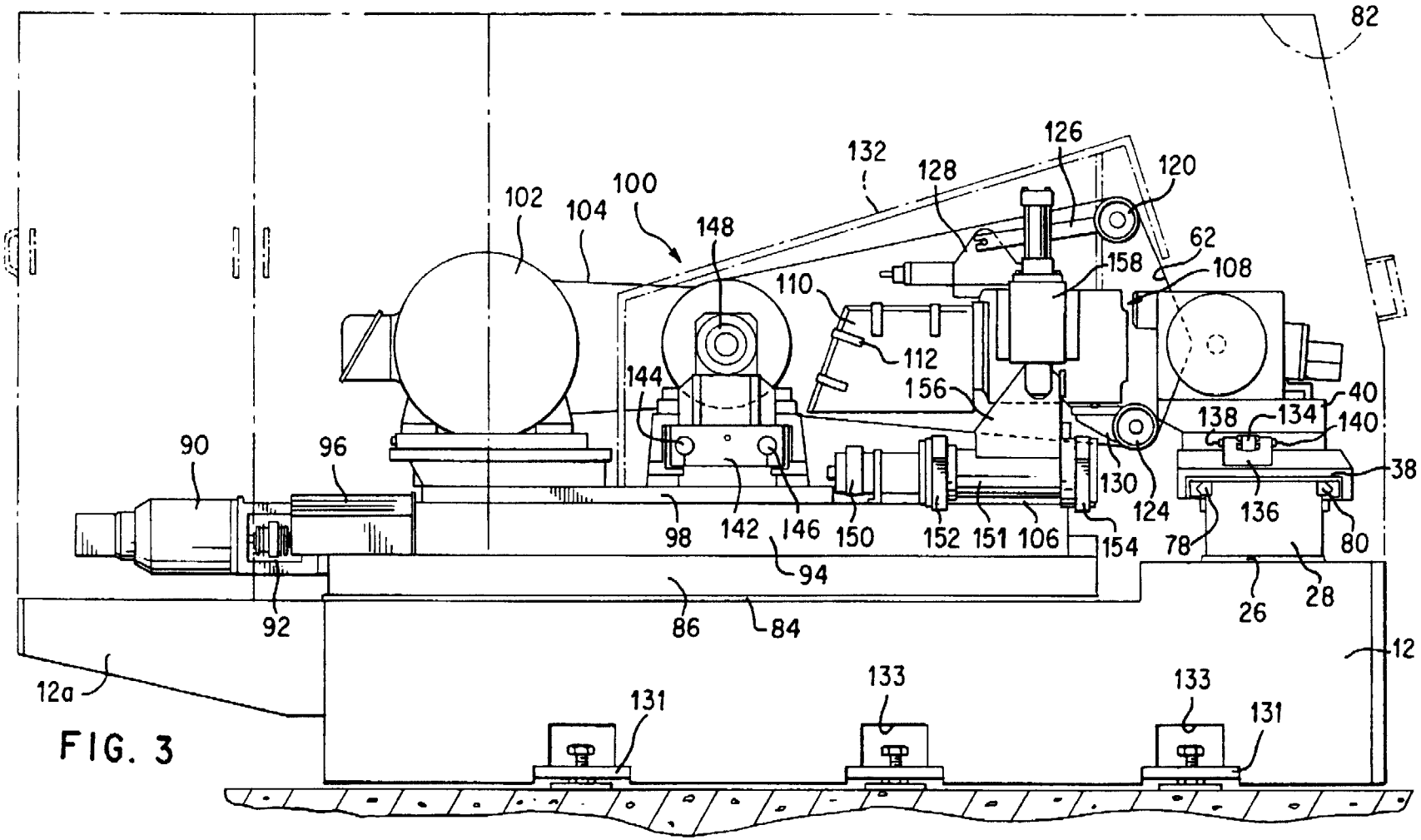
FIG. 3 is another side elevational view of the grinding machine shown in FIG. 1, such view being taken on the left side of the machine.

FIG. 3, which shows the left side of machine 10, reveals structural details not discernible in FIG. 2. Protective cover 132 reduces spattering from the fluid (coolant and/or lubricant) used during the grinding operations. A depending pin 134 on swivel table 40 extends downwardly into upwardly opening yoke 136 on carriage 38. Set screws 138, 140 can be adjusted so that the pin 134 is shifted, a fraction of an inch, within the yoke for precise alignment of table 40.

Drive drum assembly 100 includes end bracket 142, that is capable of lateral, or transverse movement, along with guide rods 144 and 146. During grinding operations, the bracket 142 supports the central shaft 148 of the drive drum assembly and is only shifted laterally, with the guide rods 144, 146, when the grinding operations have been terminated, and access to the drive belts is needed.

A hydraulic motor 150 is secured to base 106, and is connected to pivotable shaft 151, via couplings (not shown). Pivotable shaft 151 is mounted within bushings 152, 154. An arm 156 is secured to pivoting shaft 151 and is driven thereby. The operation of hydraulic motor 150 thus controls the pivotal movement of arm 156. A hydraulic cylinder 158 is secured to the side of contouring head assembly 108, in operative relationship to arm 156.

Figure 4:
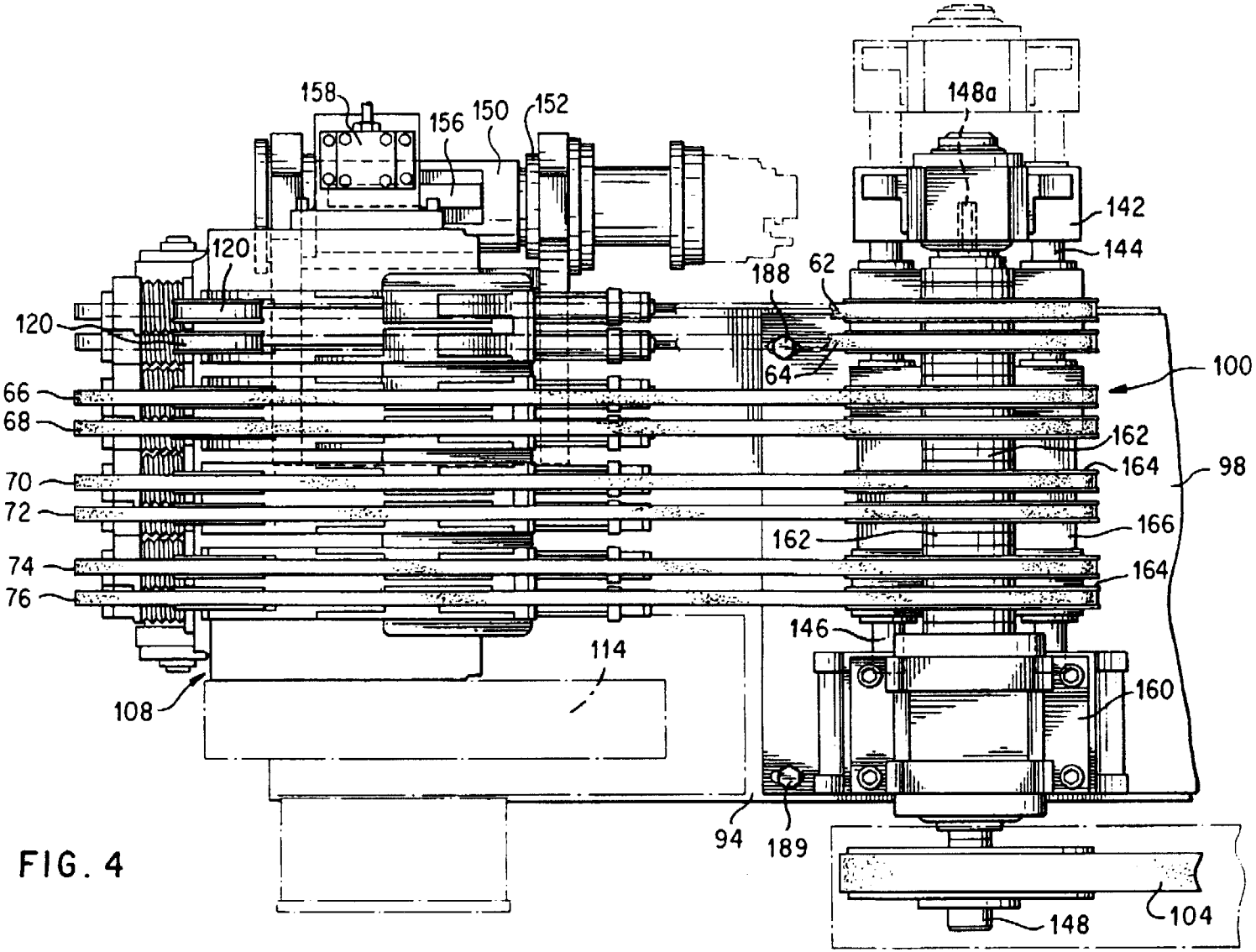
FIG. 4 is a fragmentary, top plan view of the grinding machine shown in FIG. 1, with the camshaft to be ground omitted for the sake of clarity.

FIG. 4 shows that drive drum assembly 100 includes a central shaft 148 that extends laterally across drive base 98 and underlying positioning slide 94. Shaft 148 extends between fixed bearing support 160 and laterally movable end bracket 142 at opposite sides of base 98. A projecting nose 148*a* is locked within outboard support bracket 142, when machine 10 is operating. Bracket 142, along with guide rods 144, 146, is shifted laterally by a hydraulic cylinder, to a retracted position shown in dotted outline. In the retracted position, the operator may gain ready access to the several parallel abrasive belts 66, 68, 70, 72, 74 and 76. Fragmentary portions of abrasive belts 62, 64 are shown. The fragmentary views of belts 62, 64, and the omission of the camshaft 46 to be ground by the abrasive belts, enhance the clarity of FIG. 4.

Spacers 162 are slid onto central shaft 148 to position large pulleys 164 therealong, at spaced intervals. Large pulleys, or drums, 164 may be crowned slightly (not shown) to enhance the tracking of the abrasive belts over the pulleys, and the pulleys have raised side walls to prevent the abrasive belts from slipping sidewards. Rotational power is imparted to shaft 148, and the pulleys 164 positioned thereon, by drive belt 104; only a fragment of the drive belt 104 is visible in FIG. 4.

Guide rods 144 and 146 extend through a guide block 166 that is situated between fixed bearing support 160 and outboard support bracket 142. When it is necessary, or desirable, to inspect, service, and/or replace one or more of the set of abrasive belts, bracket 142, and the guide rods 144, 146, are shifted laterally to the disengaged position shown by the dotted outline in FIG. 4. Access is then afforded to inspect, service, repair and/or replace the abrasive belts, as necessary. Such ready access to the abrasive belts reduces operating expenses by minimizing down-time for maintenance and/or replacement.

Drive drum assembly 100 is mounted upon positioning drive base 98, which moves longitudinally with positioning slide 94, under the control of motor 90 at the rear of the machine. Drive drum assembly 100 extends laterally across drive base 98, as shown in FIG. 4.

Figure 6:
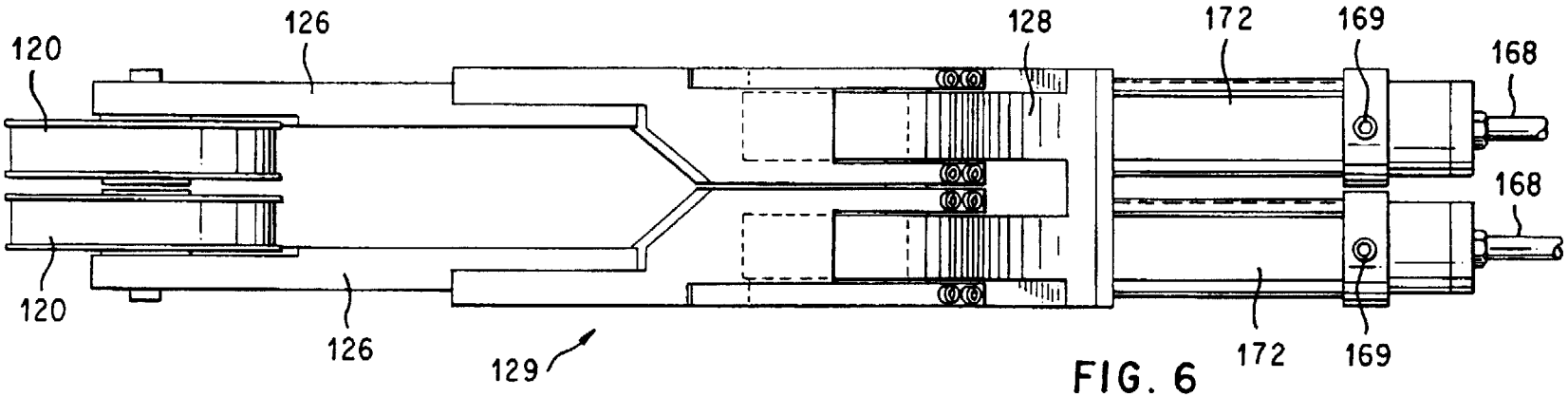
FIG. 6 is a top plan view, on the same scale as FIG. 5 of the belt tensioning mechanism.
Figure 5:
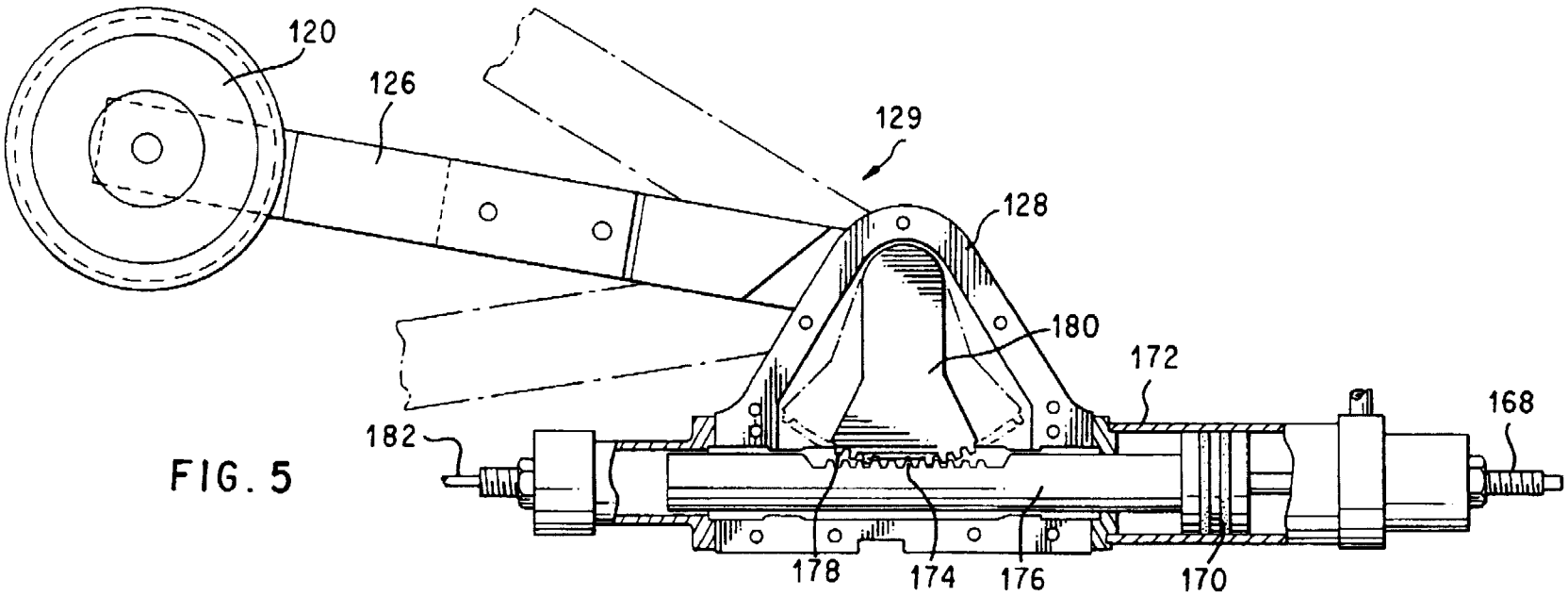
FIG. 5 is a side elevational view of the belt tensioning mechanism, on an enlarged scale, with sections broken away.

FIGS. 5 and 6 show the details of a tensioning mechanism 129 for adjusting, and maintaining, the tension on one of the endless abrasive belts employed within machine 10. Each abrasive belt is tensioned in the same manner as respective tensioning mechanism 129, and so only one mechanism 129 will be described in detail. Adjustment screw 168 is manipulated to establish a tension on a spring (not shown) disposed within housing 128 and operatively associated with piston 170. Pneumatic pressure is supplied to inlet port 169 from a suitable source and under a control to be subsequently described, and urges piston 170 to move axially within cylinder 172. A gear rack 174 is situated on the upper surface of piston rod 176, and the teeth 178 on pivotably mounted sector gear 180 mesh with the gear rack. Sector gear 180 is secured to the inner end of arm 126, such that the movement of sector gear 180 adjusts the position of arm 126 and pulley 120 secured to the free end of the arm. Consequently, by increasing the pressure at inlet port 169, and adjusting the tension in the spring, pulley 120 is pivoted clockwise to increase the tension in the abrasive belt passing thereover. A proximity switch 182 is located at the end of housing 128 remote from adjustment screw 168. When an abrasive belt breaks, arm 126 pivots clockwise and the end of rod 176 approaches, or contacts, switch 182, thus sending a warning signal to the machine operator.

Figure 7:
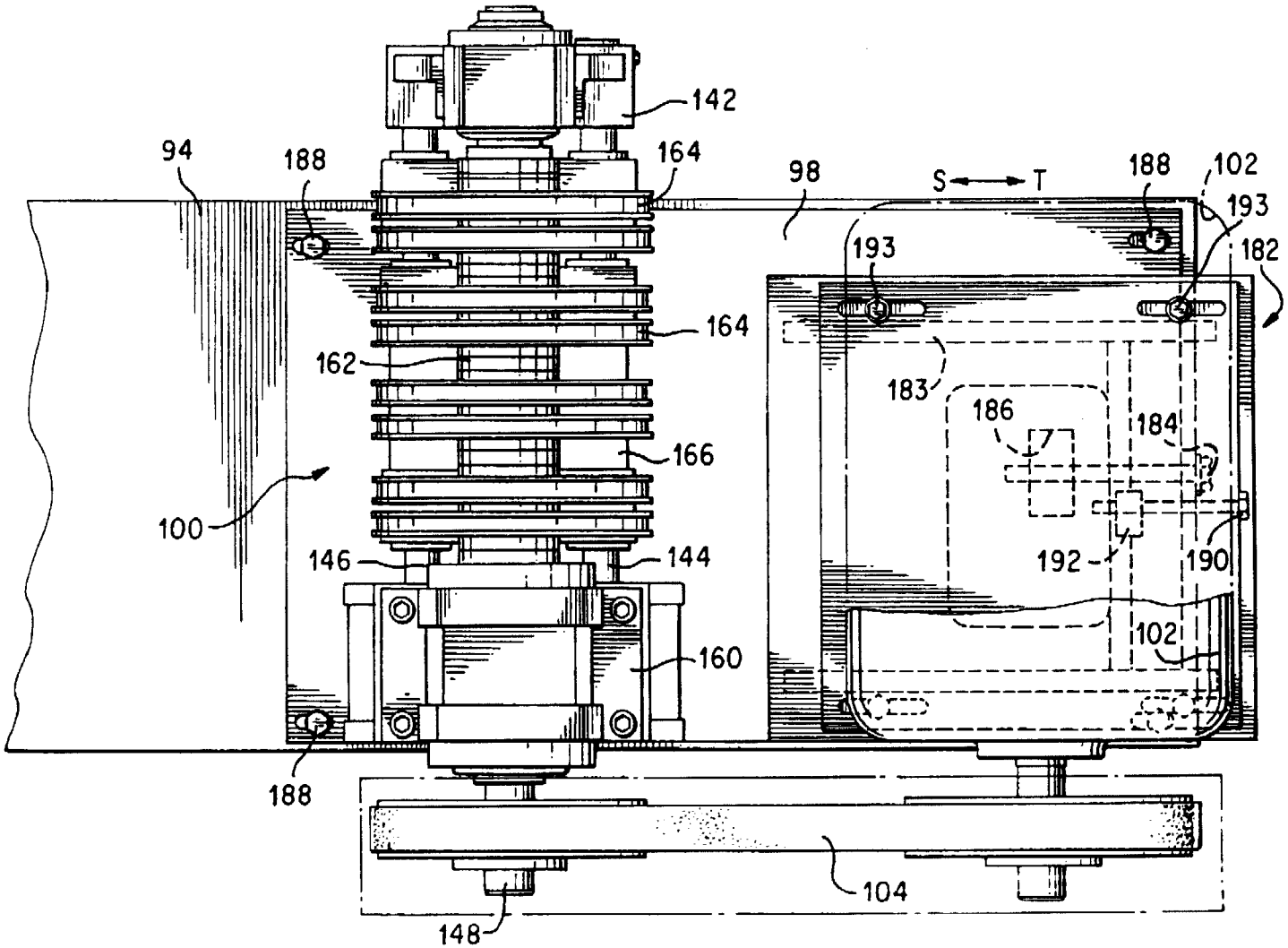
FIG. 7 is a fragmentary, top plan view of the grinding machine of FIG. 1, showing adjustment mechanisms.

FIG. 7 shows that drive drum assembly 100 and electric motor 102 are both mounted upon drive base 98, which, in turn, is positioned atop positioning slide 94. A pedestal 183 comprising a pair of plate-like members and vertical stand-offs support the prime mover. The outlines of the stand-offs are shown in dotted outline in FIG. 7.

Electric motor 102 may be shifted longitudinally in the direction of arrows S–T, a short distance along drive base 98 to adjust the tension in drive belt 104. A bolt 184 cooperates with a first follower 186 mounted to drive base 98 to exert sufficient force on prime mover 102 to shift same longitudinally. A pin and slot mechanism (not shown) enables the movement of the prime mover relative to the drive drum assembly 100, while maintaining a substantially parallel relationship. After the prime mover has been shifted longitudinally, clamping bolts 193 are tightened within slots in the pedestal to maintain the adjusted position.

Also, due to variances in the circumference, or length, of the endless abrasive belts, which are approximately 132 inches in length, adjustment may be required beyond that obtainable with the adjustment of arms 126 of tensioning mechanism 129 (shown in FIGS. 5 and 6). For such purpose, second bolt 190 and second follower 192 are provided. By rotating second bolt 190, drive base 98 and the components mounted thereon are shifted longitudinally, as a unit, to compensate for variances in the circumference of the abrasive belts passing over the large pulleys 164 of the drive drum assembly 100. Once again, the actual movement of drive base 98 relative to positioning slide 94 occurs through a second pin-and-slot connection (not shown). Clamping bolts 188 are then tightened to maintain the adjusted position of the drive base.

Figure 8:
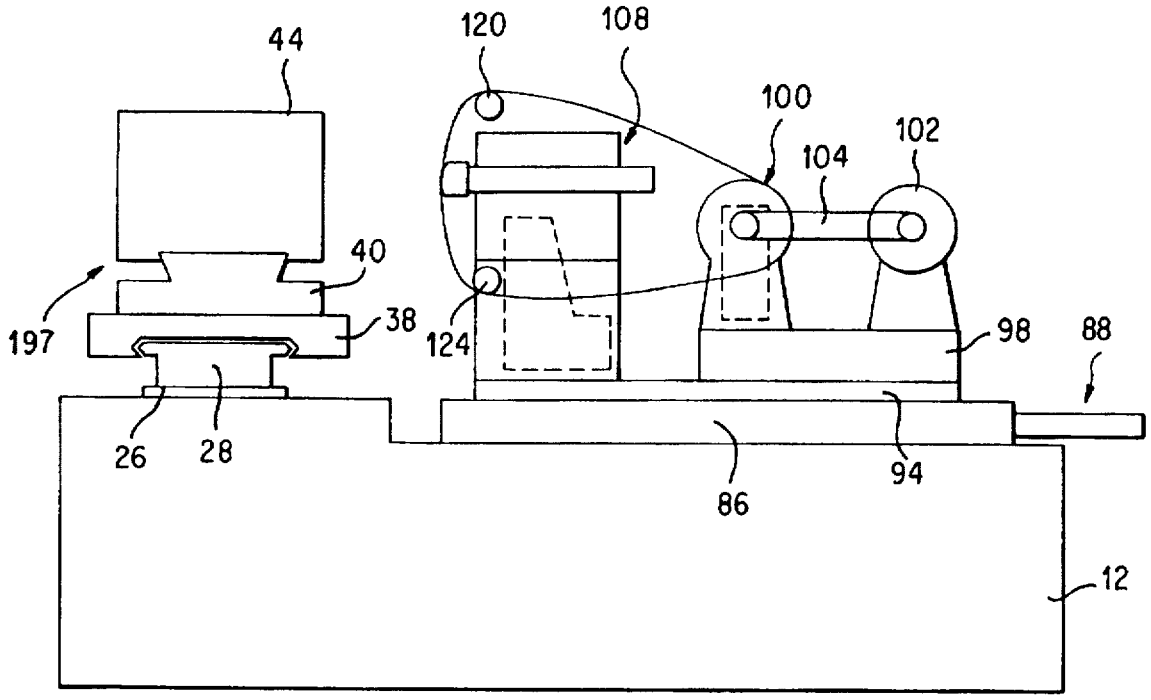
FIG. 8 is a schematic diagram correlating the carriage slide assembly, the positioning slide feed assembly, the contouring head assembly, and the mechanism for training an abrasive belt.

FIG. 8 schematically interrelates the carriage 38, swivel table 40, and tailstock 44, which may be considered as a carriage assembly 197, and positioning slide 94, and the several components supported thereon. Such assemblies move along perpendicular axes to bring the workpiece and the contouring head assembly, with its multiple, parallel abrasive belts, into alignment.

FIG. 8 shows that traversing carriage assembly 197 moves relative to fixed base 28 that is bolted to pad 26 on the bed 12 of the machine. Tailstock 44 is secured to swivel table 40 by a dovetail connection. Swivel table 40 carries headstock 50, workholders 54, 56, 58, 60 and cam shaft 46.

Positioning slide 94 longitudinally advances the contouring head assembly 108, with its multiple abrasive belts and contouring feed units, into position to grind the lobes on the camshaft 46. Positioning slide 94 moves along second base 86, which is also bolted to bed 12 of machine 10. Second base 86 is fixed, or bolted into fixed position, and performs a support function similar to that of first base 28. Motor 90, flexible coupling 92, etc. are omitted from FIG. 8, but such components deliver sufficient force to positioning slide 94 to advance or retract, same, along second base 86.

Drive base 98, which supports electric motor 102 and drive drum assembly 100, rests atop positioning slide 94. Drive belt 104 delivers power from electric motor 102 to drive drum assembly 100. Several abrasive belts are trained over the several large pulleys within drive drum assembly 100 and electric motor 102 empowers such abrasive belts.

Contouring head assembly 108 is integral with positioning slide 94. Pulleys 120, 124 are respectively secured above, and below, the front of contouring head assembly 108, and define the path of travel for the abrasive belts.

Figure 9:
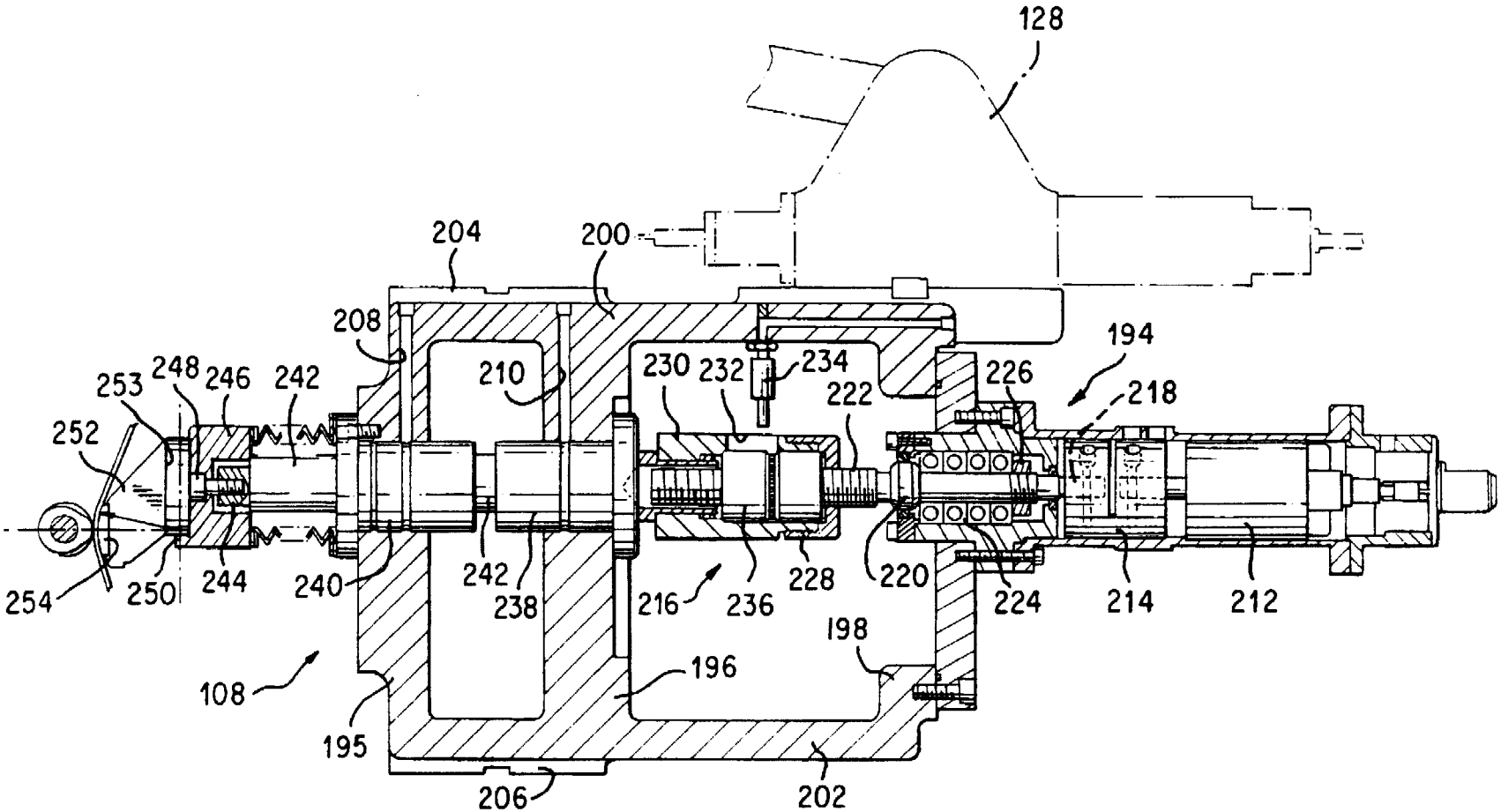
FIG. 9 is a side elevational view of a contouring feed unit employed within the grinding machine shown in FIG. 1.

FIG. 9 shows a representative contouring feed unit 194. Contouring head assembly 108 includes several identical contouring feed units 194. Contouring head assembly 108 includes a sturdy metal frame including front wall 195, intermediate wall 196, rear wall 198 with an access opening, top 200, and bottom 202. First pads 204 may be disposed along top 200, and second pads 206 are disposed on bottom 202 of the contouring head assembly 108. The pads serve as reference points in the assembly, and alignment, of the various components of the contouring head assembly. First lubrication channel 208 extends downwardly through front wall 195, and second lubrication channel 210 extends downwardly through intermediate wall 196.

Contouring feed unit 194 includes drive motor 212, which may be a brushless servo-motor, coupling 214, and roller screw mechanism 216. Coupling 214 receives, and retains, the output shaft of motor 212 and elongated shaft 218 of a roller-screw mechanism 216. Annulus 220 is defined on shaft 218, and the end of the shaft remote from coupling 214 cooperates with threaded shaft 222. Bearings 224 are "squeezed" between annulus 220 and bearing nut 226. Shaft 222 passes through end cap 228 of collar 230, and through internally threaded nut 236 retained within an axial bore within collar 230. Rotation of shaft 222 causes collar 230 to move axially in response to the force generated by motor 212. A slot 232 is defined in collar 230, and nozzle 234 allows lubricant to drip into the interior of collar 230 to lubricate the roller screw and nut mechanism retained within collar 230. The lubricant drips into a slot between the two halves of nut 236; the lubricant passes radially inwardly to lubricate the roller-screws retained within nut 236.

Ball splines nuts 238, 240 are positioned in bores in intermediate wall 196 and front wall 195, respectively, of contouring head assembly 108, and the shaft 242 of a ball-spline mechanism passes axially therethrough. The forward end of collar 230 is joined to the rear of ball-spline shaft 242. Additional details of the ball-spline mechanism are not shown, since such mechanism can be purchased as an off-the-shelf item. The sleeves are fixed, and only the shaft 242 of the ball-spline mechanism can translate longitudinally. The extent of longitudinal movement of collar 230 dictates the extent of movement of shaft 242. Channels 208, 210 deliver lubricant to ball-spline nuts, or collars, 238 and 240.

The forward end of shaft 242 of the ball-spline mechanism terminates in a nose 244, and a threaded bore is drilled axially into the nose. An adaptor 246 is secured to nose 244 of shaft 242 by threaded fastener 248. A locating lip 250 projects from the front face of adaptor 246, and a base 253 of back-up shoe holder 252 is seated thereon, so that back-up shoe 254 contacts the inner surface of the abrasive belt passing thereover in a correct, and accurately located, disposition as will be hereinafter explained. The mechanism roller screw 216 thus translates the rotational driving force of motor 212 into a longitudinally directed force that can press the back-up shoe and abrasive belt very firmly against the workpiece to be ground, when such cycle of operation is dictated by the control system, including programmable controller 75 and control unit 77 for machine 10.

Figure 10:
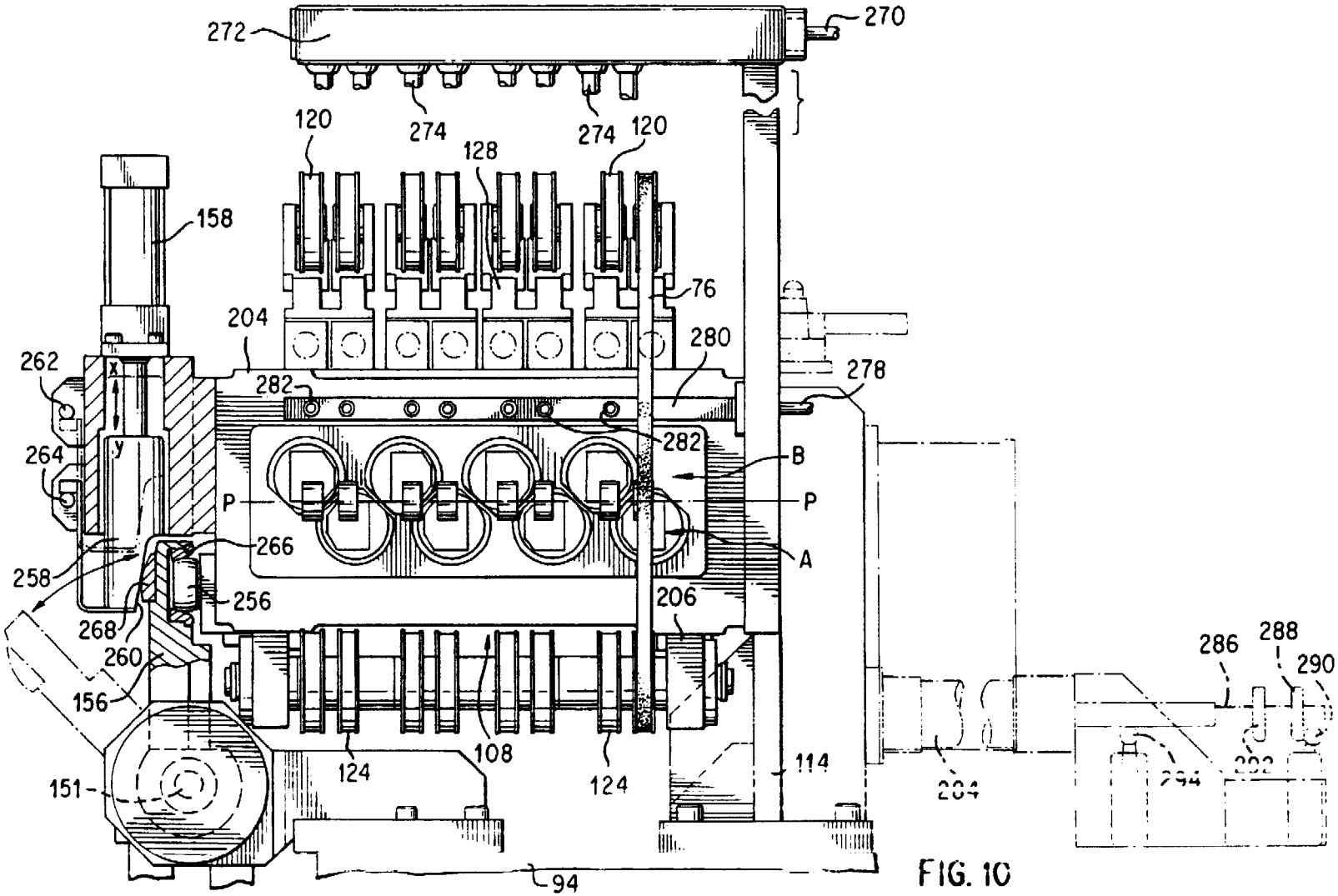
FIG. 10 is a front elevational view of the contouring head assembly, employed within the grinding machine shown in FIG. 1, and the outboard locking mechanism therefor.

FIG. 10 is a front elevational view of contouring head assembly 108, and the supporting and locking mechanisms therefor, that rigidify and strengthen such assembly. Assembly 108 is secured to positioning slide 94 and moves in concert with the slide. The right, or inboard, side of assembly 108 is bolted to standard 114, but the left, or outboard, side of assembly 108 is not similarly supported, but projects laterally in a cantilevered manner. In order to maintain the high degree of "stiffness" present throughout machine 10, and to avoid any sag, of even a minute fraction of an inch, a unique locking mechanism is utilized to support the outboard end of contouring head assembly 108.

The locking mechanism includes ball-shaped protrusion 256 on the outboard wall of assembly 108, and hydraulic cylinder 158 mounted on a stable support above the protrusion. Hydraulic cylinder 158 drives a plunger 258, with a tapered face 260, in the vertical direction; the direction of movement of the plunger is indicated by the directional arrows x and y. Switches 262, 264 detect the extended, or retracted, positions of plunger 258.

When hydraulic cylinder 158 retracts plunger 258 upwardly, hydraulic motor 150 may be energized so that arm 156 pivots to its inoperative position, shown in dotted outline, from its locking position, shown in solid lines. In its vertical, locking position, socket 266 engages protrusion 256 securely. Hydraulic cylinder 158 may then be pressurized to force plunger 258 downwardly. Tapered face 260 on the plunger slides over cam 268 secured to the upper end of arm 156; the interaction between these surfaces multiplies the "squeezing" action of the protrusion, or ball, 256 and the socket. The locking mechanism is sturdy enough to absorb any sideward thrust forces, and effectively locks the contouring head assembly in fixed position.

The vertical relationship of pulleys 120 and 124 relative to contouring head assembly 108 is shown in FIG. 10. Only abrasive belt 76 is shown trained about upper pulley 120 and lower pulley 124; the other parallel abrasive belts are omitted for the sake of clarity. In order to deliver lubricant to each abrasive belt, lubricant is introduced from a source (not shown) over conduit 270 into manifold 272; the manifold discharges the lubricant into smaller flexible pipes 274 that depend from the manifold. Each individual pipe delivers lubricant to nozzle 276 (visible in FIGS. 2 and 16) that dispenses such fluid onto the outer surface of an abrasive belt to lubricate and/or cool same.

Lesser quantities of lubricant may also be discharged upon the inner surface of each abrasive belt. To obtain such objective, lubricant from a source (not shown) is delivered, via conduit 278, to minor manifold 280; metal pipes 282 of small diameter discharge the contents of manifold 280 against the inner surface of each abrasive belt.

A large hydraulic cylinder 284, with a laterally extending rod 286, is shown in dotted outline in FIG. 10. The cylinder is operatively associated with drive drum assembly 100 and is connected to control unit 77 to be operated therefor. When rod 286 is extended outwardly, as may occur when the drive drum assembly is in the operative position, and the belts are properly entrained, ring 288 trips switch 290. When the rod is drawn inwardly by piston 284, as when the end bracket 142 of drive drum assembly 100 is moved laterally to facilitate servicing the abrasive belts, ring 292 trips switch 294.

Figure 11:
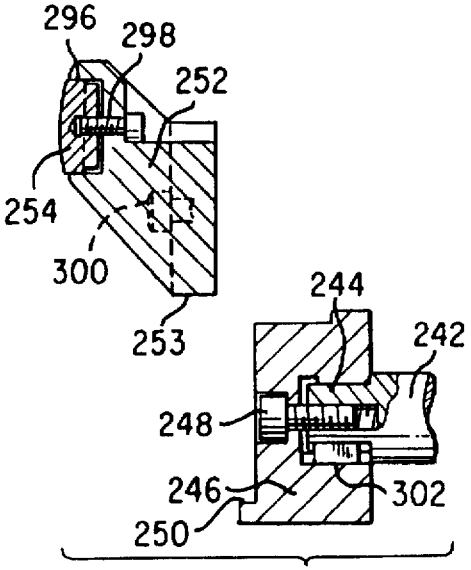
FIG. 11 is a side elevational view of the back-up shoe assembly used in each contouring feed unit, such view being exploded to reveal the details of the components of the assembly.

FIG. 11 shows clearly the structural details of an adaptor 246 with its locating lip 250; back-up shoe holder 252 with base 253; and back-up shoe 254. Back-up shoe 254 consists of a curved shoe, or crown, and a base of slightly smaller size. The base fits within recess 296 in back-up shoe holder 252, with a slight clearance. Screw 298 enters a bore in the base of shoe 254, and draws the shoe into secure engagement with holder 252.

After back-up shoe holder 252 is seated upon locating lip 250 so that the rear surface of base 253 of the holder is flush against the forward surface of adaptor 246, a number of screws 300 are advanced through bores 301 (FIG. 19) in holder 252 to secure holder 252 to adaptor 246.

The axial bore in nose 244 on ball-spline shaft 242 fits into a cavity extending inwardly from the rear of adaptor 246. Key 302 insures the proper radial orientation of adaptor 246 upon ball-spline shaft 242. Threaded fastener 248 extends axially from the front of adaptor 246 into nose 244 of shaft 242 and secures the ball-spline shaft and adaptor together.

Figure 12:
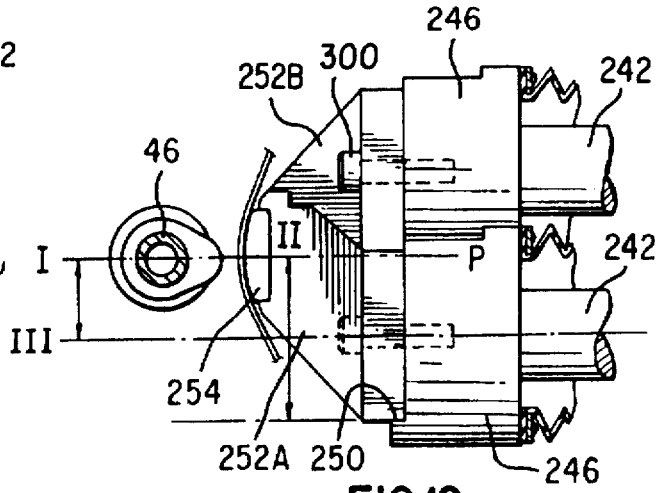
FIG. 12 is a side elevational view of a pair of back-up shoe assemblies.

FIG. 12 reveals that a diameter line I drawn through the base circle of a cam lobe on workpiece or cam shaft 46 is preferably established to be co-linear with a diameter line II drawn through the center of, and intersecting the face of, the back-up shoe 252 that is to be aligned with, and coact with, such cam lobe. Both lines I and II are preferably established to be parallel with a line III that extends along the line of action, or movement, of ball-spline shaft 242. To accomplish this significant, co-linear, relationship for all of the cam lobes on a workpiece to be ground, and their respective back-up shoes 254, the locating lips 250 on all of the adapters 246 must be accurately located with respect to the back-up shoe diameter line II as will be hereinafter described. Once accomplished for all cam lobes to be ground, and their respective back-up shoes 254, work diameter lines I and shoe diameter line II will preferably all lie in a plane P, and line of action line III will also lie in a plane III that is parallel to plane P.

Contouring head assembly 108 for machine 10 is shown in FIGS. 4 and 10 as having eight contouring feed units 194 arranged in two arrows A and B (FIG. 10) with four such units 194 in each row. Back-up shoes 254 must be disposed with their respective diameter lines II (FIG. 11) aligned in the single, preferably horizontal, plane P (FIGS. 10 and 12). To accomplish this objective, back-up shoe holders 252A disposed in row A are arranged in a first, or up, disposition, while back-up shoes 252B disposed in row B are arranged in a second, or down, disposition. The configuration and construction of back-up shoe holders 252 is such as to permit the identical back-up shoe holders 252 to be so disposed and, when so disposed, to mount back-up shoes 254 so that their respective diameter lines II will all lie in the same plane P. Bores 301 of adapters 246 are disposed to receive screws 300 whether back-up shoe holders 252 are disposed in their up or down dispositions. It should be understood that while machine 10 is shown with eight contouring feed units 194 disposed in two rows, that more, or less feed units 194 may be utilized depending upon the number of cam lobes on the workpiece. Such units 194 may, if desired, be disposed in a single row, or other desired disposition as long as the respective diameter lines II through the respective back-up shoes 254 lie in plane P.

Figure 19:
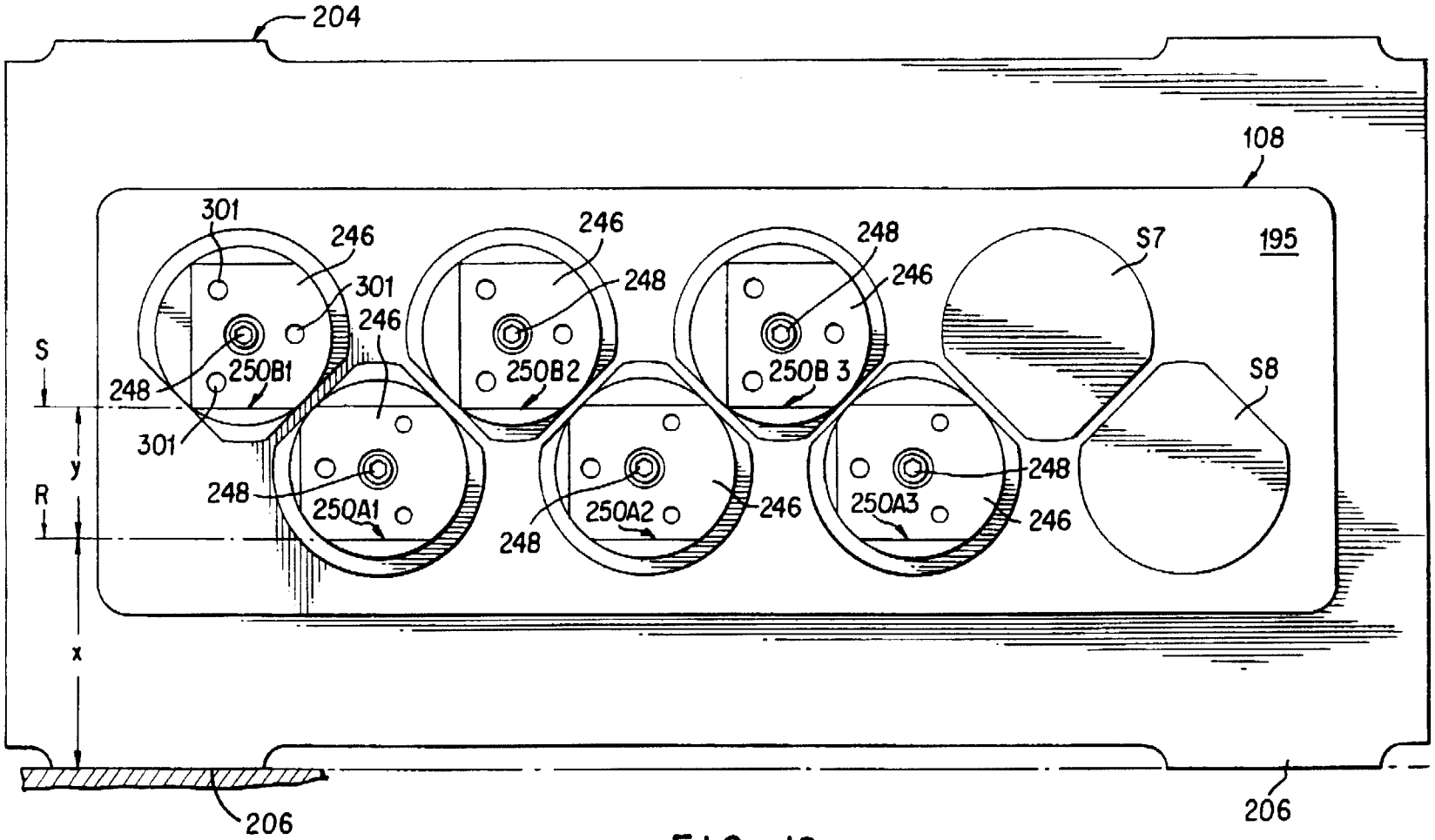
FIG. 19 is a front elevational view of the contouring head assembly showing the upper and lower rows of adapters.

To facilitate locating back-up shoes 254, as described above, adapters 246 are formed with their respective locating lips 250 oversized in the vertical dimension. After assembly of the required number of adapters 246 to their respective ball spline shafts 242 by screws 248 (FIGS. 11 and 19), lips 250 thereof are disposed somewhat aligned, and for subsequent alignment and disposition, in two parallel planes R and S (FIG. 19). In FIG. 19 the adapters 246 for only six of the eight feed units 194 are shown for head assembly 108; the other two stations S7 and S8 are unused to show details of front wall 195 of assembly 108.

After adapters 246 are so assembled to assembly 108, the assembly is positioned for a grinding operation; with all lips 250 in row A (250A1, 250A2 and 250A3) being ground to lie in plane R and all lips 250 in row B (250B1, 250B2 and 250B3) being ground to lie in plane S. The respective disposition of planes R and S with respect to each other (i.e. the spacing "y" of one from the other) will depend upon the size and configuration of back-up shoes 254 while the respective disposition of planes R and S in respect of assembly 108 is determined in respect of the workpiece to be ground. As such, lips 250 in row A are preferably ground first, to lie in plane R selected at a predetermined location with reference to a convenient place on assembly 108 such as a distance "x" from the bottom of pad 206 (or at a selected distance from the top of pad 204 or some other convenient reference place to accurately measure from). Lips 250 in row B are thereafter ground at the selected spacing "y" from plane R. If desired, lips 250 in row B may be ground first.

Figure 13:
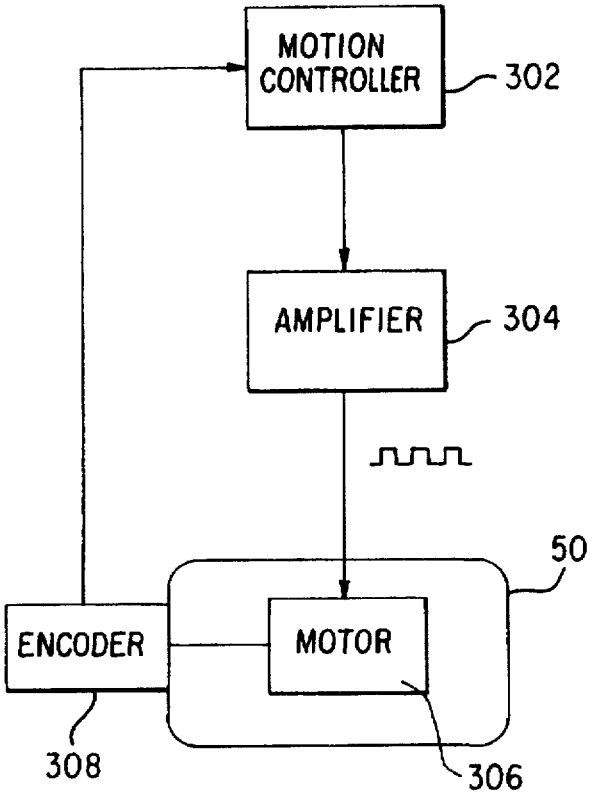
FIG. 13 is a schematic diagram showing the manner in which the motor in the headstock is digitally controlled.

FIG. 13 shows a schematic diagram illustrating the manner in which headstock 50 is controlled by digital circuitry in contrast to conventional analog control circuits. Motion controller 302 is energized to produce a torque signal, which passes through amplifier 304, and thence to brushless motor 306. As the shaft of motor 306 rotates, encoder 308 counts the number of revolutions and sends such information back to motion controller 302. Motion controller 302 automatically compensates for the difference between the number of revolutions reported by encoder 308, and the target speed for motor 306, and alters the digital control signal to amplifier 304 accordingly.

Figure 14:
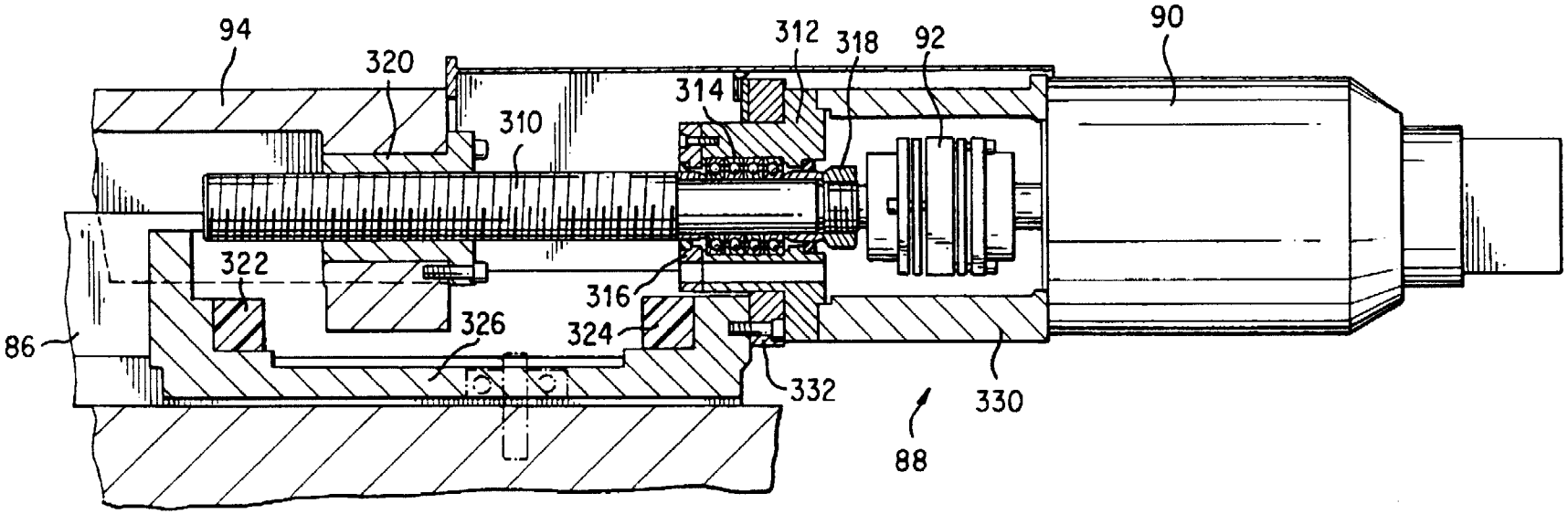
FIG. 14 is a side elevational view, on an enlarged scale, of a fragment of the drive motor, flexible coupling, and lead screw mechanism operatively associated with the positioning slide feed mechanism.

FIG. 14 shows the salient features of positioning slide feed assembly 88, on an enlarged scale. Assembly 88 includes motor 90 that transmits rotational force, through flexible coupling 92, to one end of lead screw 310. Lead screw 310 passes axially through bearing housing 312; bearings 314 are located on the unthreaded shank of lead screw 310 between seal 316 and lock nut 318. The forward end of lead screw 310 passes through internally threaded ball nut 320. The threads on ball nut 320 and the lead screw are complementary, and ball nut 320 is bolted to positioning slide 94.

Consequently, as lead screw 310 rotates, it causes ball nut 320 to longitudinally advance, or retract, positioning slide 94 relative to second base 86. The extremes of travel for ball nut 320, and thus the positioning slide 94, are defined by spaced stops 322 and 324. An upward open segment of base 86 retains the stops in position. Coupling 92 is retained within coupling housing 330, and plate 332 assists in securing assembly 90 in operative position.

Figure 15:
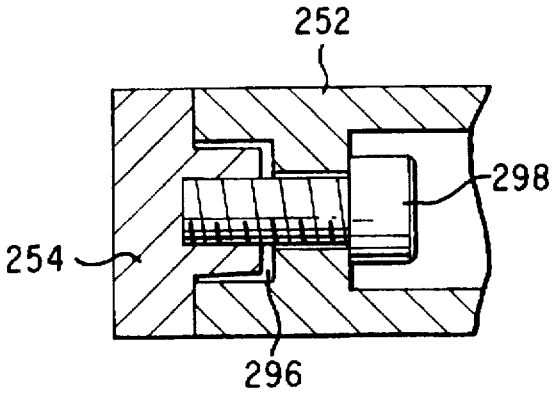
FIG. 15 is a view, on a greatly enlarged scale, showing the manner in which a back-up shoe is secured to a back-up shoe holder.

FIG. 15 shows, on an expanded scale, the manner in which back-up shoe 254 is drawn into back-up shoe holder 252 by screw 298. As rotation of the screw draws the shoe into the associated recess in holder 252, the sides of the holder contact the rear face of shoe 254 at spaced locations. Contact is thus established over a relatively wide area, and the shoe is securely seated, although clearance 296 is maintained between the inner face of the back-up shoe and the back-up shoe holder in the central area of the back-up shoe holder.

Figure 16:
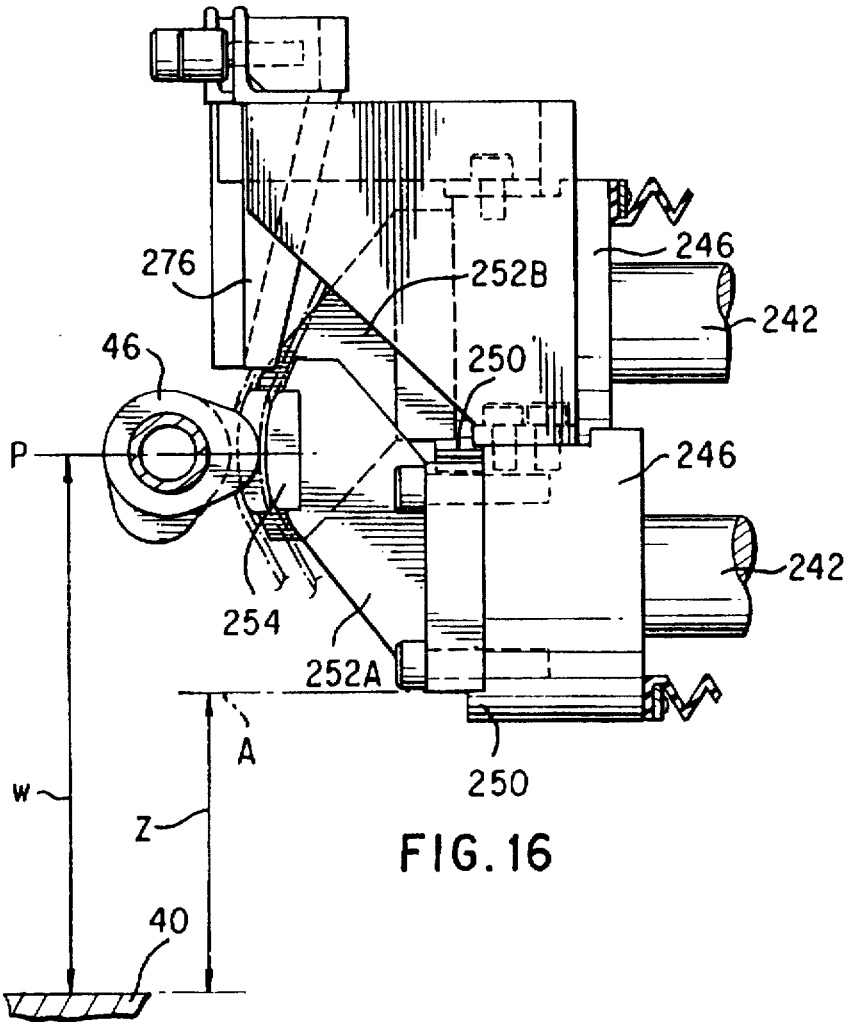
FIG. 16 is a side elevational view of a pair of back-up shoe assemblies, such view correlating the locating lips for the shoe assemblies, the center line of the workpiece, and the top of the swivel table.

FIG. 16 points out that camshaft 46 has been described above, as being located to be ground between a tailstock 44 (FIG. 1) and a headstock 50, and upon spaced workholders 54–60, all of which components are carried by a swivel table 40. As such, the axis of rotation of workpiece 46 will be disposed in a plane a distance "w" (FIG. 16) above the top of swivel table 40. However, as described above, and with particular reference to FIG. 12, in order to achieve a most accurate grinding of the cam lobes on workpiece 46, that the axis of rotation of workpiece 46 lie in plane P (FIG. 12) parallel to plane III. To accomplish that relationship the distance "z" between top of swivel table 40 and plane A (i.e. the plane in which lips 250 in row A are disposed) is determined. Thereafter, the underside of swivel table 40 is ground down in the area of the dovetail connection so that the top of swivel table 40 is, in fact, a distance "$z_1$" ($w-Q=z_1$) from plane A thereby establishing work diameter I to be coplanar with shoe diameter line II in plane P. Swivel table 40 is therefore initially sized to be oversized and is finally sized by grinding, or the like to accomplish the above objective.

A separate nozzle 276 (FIG. 16) is operatively associated with each abrasive belt to distribute lubricating fluid to each abrasive belt in the area between the exterior, abrasive side of the belt and the cam lobe on camshaft 46, being ground. The lubricating fluid cools the area of contact, reduces dust and debris, and extends the life of the abrasive belts.

Although back-up shoes 254 are aligned vertically, the shoes may be advanced, or retracted, horizontally relative to one another, while maintaining their parallel relationships, to grind cam lobes that are out of radial position with respect to one other. Such relationship is demonstrated by the pair of cam lobes shown in FIG. 16.

Figure 17:
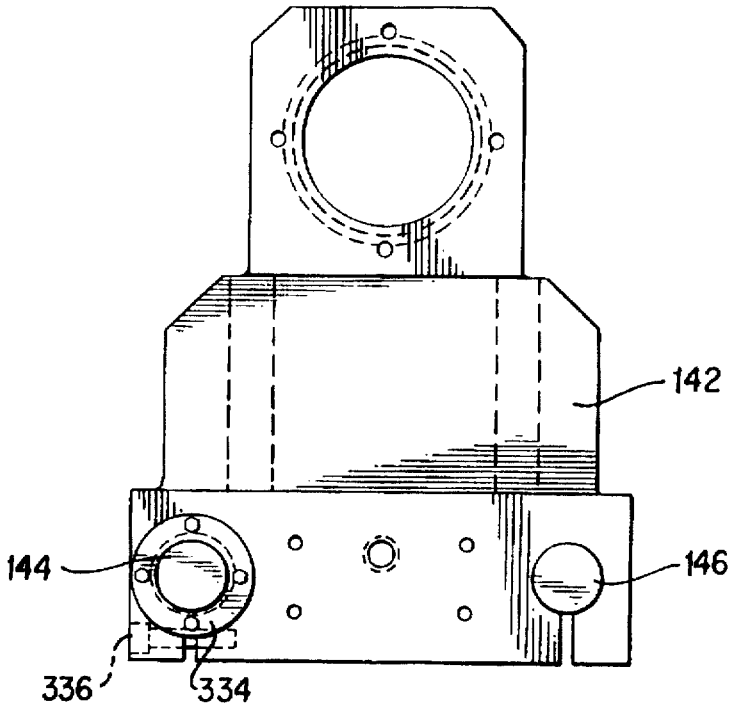
FIG. 17 is a side elevational view of the laterally movable support for the drive drum assembly.

FIG. 17 shows outboard support bracket 142 of drive drum assembly that is laterally movable with guide rods 144, 146 that extend transversely across positioning slide 94. An eccentric bushing 334 is secured about shaft 144 is secured within a bore in the base of bracket 142. Eccentric bushing 334 is thickened, in selected areas, to counteract any tendency of the bracket and guide rods to seize, or jam, within guide block 166. Screw 336 draws the base of the bracket snugly about guide rod 144.

The lateral movement of outboard bracket 142 is coordinated with the operation of the outboard locking mechanism for the contouring head assembly. Consequently, after the grinding operations have been terminated, hydraulic cylinder 158 retracts plunger 258, arm 156 is pivoted out of locking engagement with protrusion 256 by operation of hydraulic motor 150, and access is granted to the abrasive belts passing about pulleys at the front of contouring head assembly 108. Also, bracket 142 is disengaged, so that bracket 142 can be slid laterally along with guide rods 144, 146, and the drive drum assembly is readily accessible. The abrasive belts are thus exposed, for inspection, service, repair, etc., at two spaced locations on the same side of machine 10.

Figure 18:
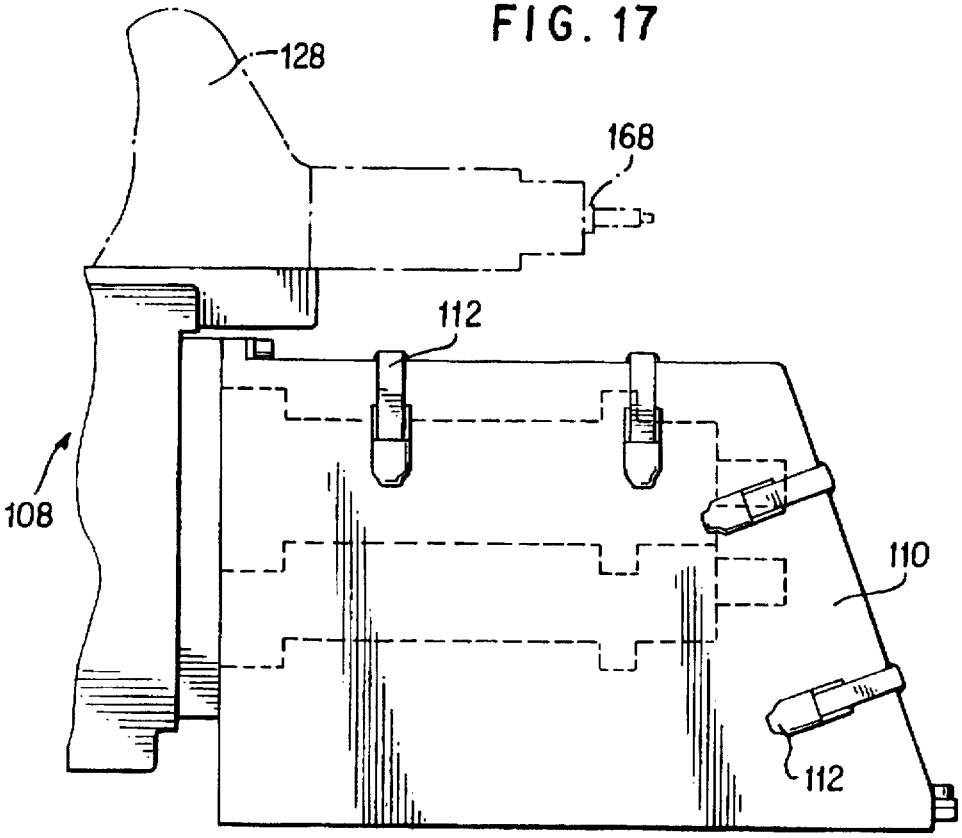
FIG. 18 is a side elevational view of the enclosure that encompasses the rear of the contouring head assembly.

FIG. 18 shows that enclosure 110 is secured to the rear surface of contour head assembly 108. The enclosure is sufficiently large to encompass the upper and lower row of contouring feed units, and extends across the entire contour head assembly so that all of the drive motors for contouring feed units 194 are sealed from debris, dust, and harmful ambient conditions that shorten the useful lives of the contouring feed units.

FIG. 19 shows the adaptor plates 246 secured to the upper and lower rows of contouring feed units. Locating lips 250 are also visible on each adaptor plate, as are the holes for securing the back-up shoe holders to the adapters. The distance from the lower row of locating lips to the bottom reference pad 206 is indicated by dimension "x", and the distance from the lower row of locating lips to the upper row of locating lips is indicated by dimension "y". As discussed previously, the distance from the row of lower locating lips 250 to bottom reference pad 206 is carefully established. Then the upper row of locating lips 250 is carefully established with respect to the lower row of locating lips. Then, as suggested in FIG. 16, the height of the center line of workpiece 46 from the top of swivel table 40 is established. Consequently, the back-up shoes 254, when secured to adapters 246, are in alignment with the cam lobes on the workpiece.

The instant machine may utilize two, four, six or eight, parallel abrasive belts to simultaneously grind a corresponding number of lobes on a camshaft or similar workpiece. The pairs of belts can be varied, as needed, to meet different production runs.

Numerous other revisions and modifications will occur to the skilled artisan in the technologies relevant to the present invention. Consequently, the appended claims should be broadly construed in a fashion commensurate with the significant advances realized by such invention, and should not be unduly limited to their literal terms and expressions.

We claim:

1. A belt grinding machine comprising a) a bed, b) a platform extending transversely across said bed, c) a first base secured to said platform, d) a carriage mounted on said first base for lateral movement therealong, e) a first motor, and first coupling means for delivering power from said first motor to said carriage to move same along said first base, f) means atop said carriage for receiving and retaining a workpiece, g) a second base fastened to said platform perpendicular to said first base, h) a positioning slide mounted on top of said second base for longitudinal movement there along, i) a second motor, and second coupling means for delivering power from said second motor to said positioning slide to move said positioning slide along said second base, j) a contouring head assembly mounted upon said positioning slide for movement therewith, k) said contouring head assembly including several contouring feed units, l) each said contouring feed unit including a back-up shoe, means for entraining an abrasive belt in operative relation to said back-up shoe, a coupling, bearing means, and a DC motor for delivering power, through said coupling to said bearing means to move said back-up shoe relative to said abrasive belt, m) each contouring feed unit having a front face for contacting said abrasive belt and a rear face remote from said abrasive belt, n) the invention being characterized by an enclosure secured about said rear face of said contouring head assembly to surround said DC motors, said enclosure preventing dust and debris from entering said DC motors and causing same to deteriorate.

2. The belt grinding machine as defined in claim 1 wherein said enclosure is formed of separate panels, and clamps are used to retain said panels together, said clamps being manually operable to permit access to said DC motors.

3. A belt grinding machine comprising:

a) a bed, b) a first platform extending transversely across the width of said bed, c) a first base secured to said first platform, and extending transversely across the front of said bed, d) a traversing carriage assembly comprising a first swivel movable along said first base, a slide table mounted atop said first slide, and a footstock and a headstock mounted upon said slide table, and adapted to receive a workpiece therebetween, e) first motor means and a first coupling for driving said first slide, f) a second platform extending longitudinally along the length of said bed perpendicular to said first platform, g) a second base secured to said second platform, h) a positioning slide mechanism including a positioning slide mounted atop said second base and a contouring head assembly secured to said positioning slide, said contouring head assembly including a plurality of back-up shoes and a like plurality of abrasive belts aligned with said back-up shoes, and second motor means for driving said positioning slide mechanism along said second base along the longitudinal axis of said machine, whereby said plurality of abrasive belts may be advanced toward and retracted from a workpiece retained between said footstock and said headstock.

4. A grinding machine for grinding the surface of a workpiece according to a predetermined contour (profile) defined by a plurality of points each disposed at a predetermined radial distance from a center of rotation of the workpiece; comprising:

a) base means;

b) workpiece mounting means carried by said base means;

d) contouring head means carried by said base means and, in turn, carrying at least one abrasive grinding belt, having a grinding surface and a backing surface, such that said at least one abrasive grinding belt is disposed with its grinding surface in proximity to and so as to coact with a surface on a workpiece, when the workpiece is mounted by said workpiece mounting means, to grind the workpiece surface to the predetermined contour;

e) shoe means, carried by said contouring head means, and having a belt contacting surface disposed so as to coact with said backing surface of said at least one abrasive grinding belt; and f) shoe positioning means carried by said contouring head means and coacting with said shoe means to control the disposition of said belt contacting surface thereof and thereby the disposition of said grinding surface of said at least one grinding belt, in relationship to a workpiece when mounted by said workpiece mounting means, to thereby grind the predetermined contour on the workpiece.

5. The grinding machine of claim 4 including digital velocity control means disposed to coact with said integral motor means to control the velocity thereof.

6. The grinding machine of claim 5, wherein said digital velocity control means is carried by said headstock means and is responsive to the rotation imparted thereto by said integral motor means.

7. The grinding machine of claim 4, wherein said contouring head carries a plurality of abrasive belts, said plurality being an even number.

8. The grinding machine of claim 7 wherein said plurality consists of at least two, but not more than eight, abrasive belts.

9. The grinding machine of claim 4, wherein said shoe positioning means includes brushless motor means disposed for advancing and retracting said shoe means along a predetermined linear path.

10. The grinding machine of claim 9, including casing means for encasing said brushless motor means to minimize the entry of dirt and fluid into said brushless motor means.

11. The grinding machine of claim 10 including linear motion means carried by said brushless motor means to effect said advancing and retracting of said shoe means along said predetermined linear path and support means coacting with said linear motion to support same for linear motion in a relatively rigid manner.

12. The grinding machine of claim 11, wherein said support means includes bearing means.

13. The grinding machine of claim 1 wherein said DC motors are brushless motors.

14. A belt grinding machine comprising:

a) a bed, b) a first platform extending transversely across said bed, c) a first base fastened to said first platform, d) a carriage mounted on top of said first base for lateral movement therealong, e) a first motor, first coupling means, and a first lead-screw mechanism for delivering power from said first motor through said first coupling means to said first lead-screw mechanism for moving said carriage along said first base, f) means atop said carriage for receiving and retaining a workpiece, g) a second platform perpendicular to said first platform, h) a second base fastened to said second platform perpendicular to said first base, i) a positioning slide mounted on top of said second base for longitudinal movement there along, j) a second drive motor, second coupling means for delivering power from said second motor to a second lead-screw mechanism for moving said positioning slide along said second base, k) a contouring head assembly, including several contour feed units, each contour feed unit including a back-up shoe and means for entraining an abrasive belt in operative relation to each back-up shoe, l) said contouring head assembly being secured to said positioning slide for longitudinal movement therewith to bring said abrasive belts into contact with the workpiece, m) the invention being characterized in that said first motor, said first coupling means, and said first lead-screw mechanism are identical in structure, and in function, to said second motor, said second coupling means, and said second lead-screw mechanism, thereby reducing inventory and storage requirements for said belt grinding machine.

15. A belt grinding machine as defined in claim 14 wherein said first coupling means and said second coupling means comprise a flexible coupling and a threaded shaft with a follower encircling same, said follower being secured to said carriage or said slide to be driven by said first or second motor.

16. A belt grinding machine comprising:

a) a bed, b) vertical supports projecting upwardly above said bed, c) a contouring head assembly secured to said vertical supports, d) a plurality of endless abrasive belts, e) a drive drum assembly carried by said bed including a central shaft with a plurality of large pulleys spaced thereon, each pulley entraining one of said endless abrasive belts, f) smaller pulleys carried by said contouring head assembly in alignment with said larger pulleys spaced along said central shaft, whereby each endless abrasive belt is also entrained about a respective smaller pulley parallel to, but spaced from, every other abrasive belt, g) said contouring head assembly also including a plurality of contour feed units, h) each said contouring feed unit including a curved back-up shoe, a holder for said shoe, actuator means for pressing said back-up shoe against the inner surface of an abrasive belt, and motor mean for supplying force to said drive means, i) a base being secured to said bed, said base extending along the longitudinal axis of said bed, j) a slide movable along said base, and a motor is provided to advance, or retract, said slide, k) upstanding bracket means located at opposite sides of said slide, l) said central shaft of said drive drum assembly extending transversely across said slide and being received in bearings in said bracket means, m) one of said bracket means being fixed to said slide, and being immobile, n) guide rods extending between said immobile bracket means and enabling the other, movable bracket means to be shifted laterally with said guide rods, to expose said large pulleys and the abrasive belts entrained thereover, o) wherein apertures are defined in the base of said movable bracket means to receive said guide rods therewithin, p) the invention being characterized in that an eccentric bushing is inserted into one of said apertures to fit about one of said guide rods, said eccentric bushing insuring that said movable bracket means can move smoothly, along with said guide rods, without seizing.

* * * * *